United States Patent [19]

Hayashi et al.

[11] 4,367,070

[45] Jan. 4, 1983

[54] PROCESS FOR TREATING FIBROUS STRUCTURE

[75] Inventors: Kazuya Hayashi; Masato Shimada; Teruo Nakamura; Yoshihiro Fujii, all of Otsu, Japan

[73] Assignee: Toray Industries, Inc., Tokyo, Japan

[21] Appl. No.: 273,948

[22] Filed: Jun. 15, 1981

[30] Foreign Application Priority Data

Feb. 21, 1980 [JP] Japan ..... 55-19747

[51] Int. Cl.[3] ..... D06Q 1/02; D06C 1/04

[52] U.S. Cl. ..... 8/114.6; 8/115.7

[58] Field of Search ..... 8/114.6, 115.7

[56] References Cited

U.S. PATENT DOCUMENTS 4,270,913 6/1981 Tse ..... 8/115.5
4,291,442 9/1981 Marco ..... 8/114.6

FOREIGN PATENT DOCUMENTS 48-41477 12/1973 Japan ..... 8/115.7
55-116874 9/1980 Japan ..... 8/114.6
55-142767 11/1980 Japan ..... 8/115.7
2026053 1/1980 United Kingdom ..... 8/115.7

*Primary Examiner*—Maria Parrish Tungol
*Attorney, Agent, or Firm*—Austin R. Miller

[57] ABSTRACT

A process for treating a fibrous structure is provided. The fibrous structure comprises at least two components at least one of which is a polyester containing an $SO_3M$ group wherein M represents hydrogen or an alkali metal. The process is characterized in that the fibrous structure is treated with an agent which deteriorates the polyester prior to the alkali treatment for the removal of the polyester component.

16 Claims, 12 Drawing Figures

PROCESS FOR TREATING FIBROUS STRUCTURE

BACKGROUND OF THE INVENTION

The present invention relates to a process for treating a fibrous structure containing polyester. It has been broadly known that the treatment of polyester fibrous structures with alkali develops a soft "hand" by partial dissolution and removal of certain materials. This treatment is primarily important for processing polyester fibrous structures.

Furthermore, it has been also known that mixtures of fibers that are easily soluble in alkalis and fibers that are difficult to dissolve in alkalis, when treated with alkalis, can produce a product having an excellent soft hand by dissolution and removal of the easily soluble fibers. However, this treatment requires a considerably long time to complete, and also results in some extent of damage by the alkali. This leads to unexpected deterioration of physical properties of the product.

On the other hand, when a more soluble component is used as the easily soluble fibers, the fibers are inadequate when subjected to mixing, blending, knitting and weaving processes, due to deterioration of physical properties. They also suffer from difficulty of fiber spinning (extruding).

The alkali treatment of mixtures of fibers, therefore, is not used in practice at present, although an outstandingly soft hand can be obtained.

When conjugated (composite) fibers contain an easily alkali-soluble component and a difficultly alkali-soluble component, and are treated with alkali to obtain micro (super) fine or special shape fibers, the problem is even more serious, since fine fibers which must remain in the structure are simply dissolved and thereby removed from the structure.

As a result of intensive studies, we have found a process for selectively dissolving only the easily alkali-soluble polyester components but not the difficultly alkali-soluble components—all in a short time and with convenience and efficiency.

DETAILED DESCRIPTION OF THE PREFERRED EMBODIMENTS

Figure 1:
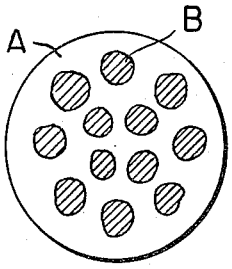
FIGS. 1 through 9 are examples of cross sections of conjugate fibers effectively treated by the process of the present invention.
Figure 2:
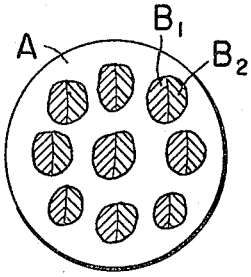

The present invention relates to a process for treating a fibrous structure comprising two components or more, at least one of which is a polyester containing the $SO_3M$ group, wherein M represents hydrogen or an alkali or alkali earth metal, characterized in pre-treating the fibrous structure with a degrading agent for the $SO_3M$-modified polyester and removal of a partial polyester component by alkali treatment.

The present invention has been found not only to produce a soft polyester fibrous structure having excellent resilience, but also to enhance the efficiency of the alkali treatment.

The fibrous structures herein involve whole fibers and processed goods such as yarns, staple fibers, tows, top, woven fabrics, knitted fabrics, and non-woven fabrics. They may contain finishing agents such as silicone resins, melamine resins or urethane resins, for example.

The fibrous structures used as starting materials for the practice of the present invention may comprise two components or more. At least one of these is a polyester containing the $SO_3M$ group. For example, they include mixtures of separately spun components produced by subsequent mixing or blending processes. They also include conjugated fibers consisting of various components as illustrated for example in FIGS. 1–9, though they are not limited thereto. In other words, the structures of the starting fibers of this invention are fibrous structures including polyester polymers at least portions of which contain the $SO_3M$ group, which can be removed by alkali treatment. These structures also contain one or more other components, but are not limited to any particular arrangements of components.

In FIGS. 1–9, component A is the easily alkali-soluble component to be removed by the alkali treatment, containing the $SO_3M$ polyester group, and B, $B_1$ and $B_2$ represent difficultly alkali-soluble components. In conjugate fibers of the "islands-in-sea" type, the sea component is generally the easily alkali-soluble component. The easily alkali-soluble polyester component to be removed by the alkali treatment is a polyester containing the $SO_3M$ group wherein M represents a metal, particularly, an alkali metal or an alkaline earth metal, or a hydrogen atom.

In consideration of both spinnability and susceptibility to alkali treatment after treatment for degradation of the polyester, the polyester should be polyethylene terephthalate copolymerized with preferably 1–15 molar %, particularly preferably 3–5 molar %, of 5-(sodium sulfo) isophthalic acid. The other (one or more) components may comprise synthetic fibers such as polyesters, polyamides or polyacryl fibers, semi-synthetic fibers such as acetate fibers, regenerated fibers such as rayon fibers or natural fibers such as cotton, wool or silk fibers, for example, all of which are rather more difficultly soluble in alkalis than the easily soluble polyester component removed by the alkali treatment.

The present invention is particularly useful when a polyester, which contains no or less amount of $SO_3M$ group than the easily soluble polyester, is used as a difficultly alkali-soluble component. In such a case, unexpected deterioration of the difficultly soluble component, which is not highly resistant to the alkali, can be reduced remarkably.

The terms "easily alkali-soluble" and "difficultly alkali soluble" as used herein are intended to be expressed in relation to their solubility, after treatment with the degrading agent but before alkali treatment.

The degrading treatment involves modification of the $SO_3M$-containing portion of the polyester to make it more susceptible to subsequent alkali treatment.

The degradation agents for polyesters in the practice of the present invention lower the average molecular weights of the polyesters. They include, for example, amines such as ethylenediamine, ethylenetriamine or monoethanolamine, zinc salts such as zinc chloride, zinc sulfate or zinc nitrate, oxidizing agents such as hydrogen peroxide, sodium hypochlorite or sodium chlorite, and acids such as hydrochloric acid, sulfuric acid, nitric acid, phosphoric acid or oxalic acid. The acids are particularly appropriate, since they selectively degrade the $SO_3M$ group-containing polyester.

The degradation treatment is effected, for example, by the following processes: treatment of the fibrous structure in a boiling aqueous solution containing the degrading agent for about 10–120 minutes; treatment wherein degrading agent is added to the fibrous structure and the product is subsequently treated with saturated vapor at 100°–130° C. for about 1–30 minutes; a process wherein dry heat or superheated steam treatment is performed at 130°–220° C. for about 1–10 minutes; and a process involving aging at 40°–60° C. for 10–30 hours. However, the applicable processes are not limited to the foregoing; any suitable process can be used, provided they cause a lowering of the average molecular weight of the $SO_3M$-modified polyester as a result of contact with one or more degrading agents. It is particularly desirable that treatment with acid in a boiling aqueous solution at below a pH of 2 for about 60 minutes, or for about 110°–140° C. at below a pH of 3 for 30 minutes, be used. The addition of a carrier, surfactant or quaternary ammonium salt in the treating bath tends to produce better results.

The alkali treatment involves hydrolysis of the modified (degraded) $SO_3M$-type polyester with an alkaline substance. In general this involves treatment of the polyester in a boiling aqueous solution of an alkaline substance such as sodium hydroxide for 30–120 minutes, or in saturated steam at 100°–130° C. for 1–5 minutes with subsequent impregnation with an alkaline substance, or dry heat or superheated steam at 130°–200° C. for 1–5 minutes, otherwise aging at 40°–60° C. for 10–30 hours.

In the process of the present invention, any such procedure can be utilized provided stable treatment can be achieved. Alkali metal or alkaline earth metal hydroxides such as sodium hydroxide or potassium hydroxide, or basic salts such as sodium carbonate or potassium carbonate, can be utilized as the alkali substance.

The characteristic features of the process of the present invention will be listed below in comparison with conventional processes:

(1) In the treatment of a fibrous structure comprising blended yarn or mixed filament yarn, substantial degradation of residual fibers can be obtained by treatment for an extended period with alkali, in a conventional process; however, in the present invention the fibrous structures achieve a much better "hand", without loss of physical properties, because of the short time treatment that is surprisingly effective. Although stable spinning or weaving cannot usually be expected when using fibers which can be removed rapidly with alkali, the process of the present invention does not encounter any trouble through the process, since treatment with a degrading agent for the modified polyester promotes the hydrolysis rate in the alkali.

Figure 3:
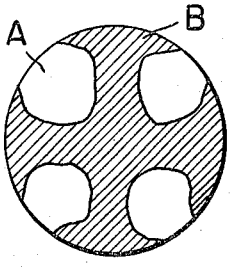
Figure 4:
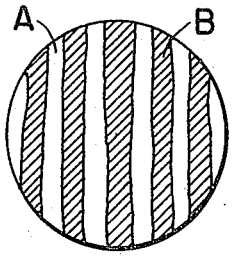
Figure 5:
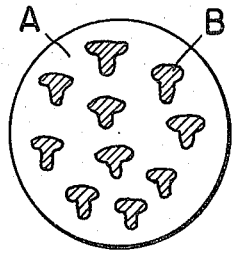
Figure 6:
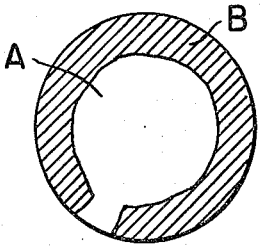
Figure 7:
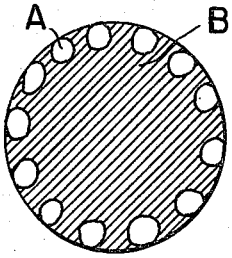
Figure 8:
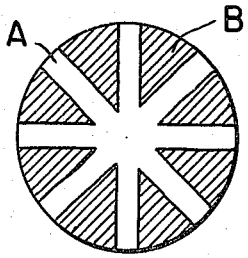
Figure 9:
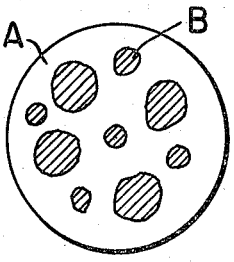

(2) The process of the present invention is particularly effective when polyester is present in both components of an islands-in-sea type conjugated fiber as shown in FIG. 3. Only the fiber shown in FIG. 11 can be obtained if the easily alkali-soluble component (A) is removed by the conventional process, because a part of the difficultly alkali-soluble component (B) is also dissolved. However, the process of the present invention effects complete removal of component (A) prior to the hydrolysis of component (B), and finally can produce a fiber of the type shown in FIG. 10. The process of the present invention actually provides for maintaining the original shape of the one component throughout the period of removal of the other component. Therefore, if an islands-in-sea type fiber, as shown in FIG. 1, is treated according to the process of the present invention, the respective independent islands can be separately created, with minimum damage to the outwardly-positioned island components. In the conventional process, the outer island components are sometimes found to disappear before the inner island components have even been separated.

(3) The alkali reduction rate of the polyester increases by use of the process of the present invention. The alkali reduction rate can also be increased by the conventional process if a quaternary ammonium salt is used in the alkali treatment. However, the alkali reduction rate of only one component is increased selectively in the process of the present invention, while the reduction rates of both components are increased in the conventional process. Therefore, the conventional process cannot achieve the remarkable effects of the process of the present invention.

Although varieties of cross-sections are shown in FIGS. 1–9 of the drawings, those having at least 5 cores in the cross-section are preferred, and those with at least 10 cores in the cross-section are particularly preferred.

The following examples further illustrate the process of the present invention, but they are not intended in any way to limit the scope of the present invention, which is defined in the appended claims.

EXAMPLE 1

Fabric of taffeta construction was woven with islands-in-sea fibers (75 denier, 36 filaments) as shown in FIG. 3 as both warp and weft. The specifications of the fibers utilized was as follows:

Component A: Polyethylene terephthalate copolymerized with 4 molar % of 5-(sodium sulfo) isophthalic acid.

Component B: Polyethylene terephthalate.

A/B ratio: 30/70

Figure 10:
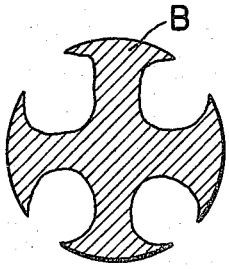
FIGS. 10 through 12 are cross sections of the conjugate fiber shown in FIG. 3, after the sea component has been removed in different ways.

The fabric was treated in boiling 1% aqueous sulfuric acid solution for 60 minutes and then in boiling 1.5% aqueous sodium hydroxide solution for 4 minutes to completely remove component A. Reduction of weight was 30.5% at this time. Thereafter, the fabric was dyed conventionally. The dyed fabric had a mild color tone, high water absorption, excellent handling qualities and was free from the problems of yarn slippage and tenacity. In the cross section of the fiber, the edges were sharp as shown in FIG. 10.

In Comparative Example 1, the fabric was treated directly in the boiling 1.5% aqueous sodium hydroxide solution, omitting the sulfuric acid treatment. The complete removal of component A took 110 minutes, with 48% reduction in weight. This fact indicates that component B had also been reduced considerably in weight.

In Comparative Example 2, the fabric was treated in the boiling 1.5% aqueous sodium hydroxide solution in the presence of 0.8% DYK-1125 (a quaternary ammonium salt; a product of Ippo Co., Ltd.). Component A was completely removed in a short period of 15 minutes, but the amount of reduction in weight was 65%. This fact also indicates that component B had been reduced very considerably in weight.

Figure 11:
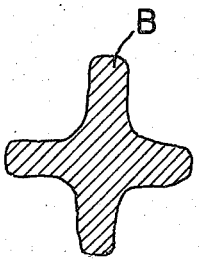
Figure 12:
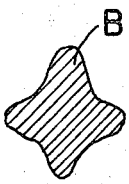

The fabrics in Comparative Examples 1 and 2 were then dyed conventionally. The dyed fabric showed considerable yarn slippage and poor tenacity, and much better effects were realized by the process of the present invention. In the cross sections of the fibers, the original shapes of component B were deformed to some extent as shown in FIG. 11 and FIG. 12, using the comparative processes.

The relative tear strengths, using an Elemendorf tear tester, are shown in the following table:

| | | |
|---|---|---|
| Process of the present invention | 1500 (g) | 1100 (g) |
| Comparative Example 1 | 800 | 500 |
| Comparative Example 2 | 400 | 200 |

EXAMPLE 2

A blended yarn of 20% staple fiber of polyethylene terephthalate copolymerized with 4 molar % of 5-(sodium sulfo) isophthalic acid with 80% wool was prepared. It was woven into a twill structure and then the fabric was passed through a conventional milling process.

The fabric was treated in boiling 0.5% aqueous hydrochloric acid solution for 60 minutes and then in boiling 0.1% aqueous sodium hydroxide solution for 35 minutes to completely remove the polyester component. Thereafter, the fabric was dyed conventionally. Thus the wool fabric showed outstanding drapability with excellent handle.

In Comparative Example 1, the fabric was treated directly in the boiling 0.1% aqueous sodium hydroxide solution for 60 minutes, omitting the hydrochloric acid treatment. The polyester component had hardly been removed and the resulting dyed textile was not characterized by good drapability or handle, unlike the product of the process of the present invention.

In Comparative Example 2, the fabric was treated in boiling 1.5% aqueous sodium hydroxide solution, omitting the hydrochloric acid treatment. The reduction in weight started in the wool component and the results were completely different from those achieved by the process of the present invention.

EXAMPLE 3

Islands-in-sea fibers (225 denier, 24 filaments) as shown in FIG. 1 were knitted into sample hosiery. The fibers had the following specifications:

Component A: Polyethylene terephthalate copolymerized with 4 molar % of 5-(sodium sulfo) isophthalic acid.

Component B: Polyethylene terephthalate A/B Ratio: 22/78 Denier of Component B in monofilament: 0.2 denier Component B: 36/filament Treatment of the sample hosiery in 10% aqueous phosphoric acid solution at 130° C. for 30 minutes and in boiling 1.5% aqueous sodium hydroxide solution for 4 minutes resulted in complete removal of component A, and made up beautiful knit hosiery comprising microfine fibers. The reduction in weight was 22.2%, but the weights of the microfine fibers from the island portions were not substantially reduced and their tenacity was 730 g/filament.

In a comparative example, the sample hosiery was treated in a boiling 1.5% aqueous sodium hydroxide solution, omitting treatment with phosphoric acid. A period of 150 minutes was required for completely removing component A. The reduction in weight amounted to 44.0%. The microfine fibers in the island portions were reduced in weight approximately 30%, on the average. Accordingly, their tenacity was also down as low as 330 g/filament.

The microfine fibers obtained by the process of the present invention had uniform thicknesses of 0.2 denier, while those obtained in the comparative sample showed a large fluctuation of 0.1–0.2 denier.

We claim:

1. In a process for treating a fibrous structure comprising a plurality of components, at least one of which is a polyester containing an $SO_3M$ group, wherein M represents hydrogen or a metal, the steps which comprise pre-treating the fibrous structure with a degrading agent for the $SO_3M$ group-containing polyester which preferentially degrades said $SO_3M$ group-containing polyester, thereby producing a fibrous structure capable of being treated in a subsequent alkali treatment step to produce a soft fibrous product.

2. A process according to claim 1, wherein said degrading agent is an acid.

3. A process according to claim 1 wherein the fibrous structure is a mixture of two or more polyester fibers of different compositions.

4. A process according to claim 1, wherein the fibrous structure contains multi-component fibers comprising two or more polyester components of different compositions.

5. A process according to claim 4, wherein the multi-component fibers have a plurality of cores in the cross section thereof and the $SO_3M$ group-containing polyester is interposed between the cores.

6. A process according to claim 5, wherein the fibers have at least five cores in the cross section thereof.

7. A process according to claim 5 wherein the fibers have at least ten cores in the cross section thereof.

8. The process according to claim 1, wherein said $SO_3M$ group-containing polyester is polyethylene terephthalate copolymerized with 1–15 mol percent of 5-(sodium sulfo) isophthalic acid.

9. In a process for treating a fibrous structure to produce a product having improved softness and handle, said structure comprising a plurality of components at least one of which is a polyester the polymeric structure of which includes an $SO_3M$ group bonded to the polymeric structure, where M represents H or a metal selected from the group consisting of the alkali and alkaline earth metals, the steps which comprise:

(a) degrading the $SO_3M$ group-containing polyester by treatment with an agent to lower the molecular weight of the polyester polymer, and (b) hydrolyzing the degraded polyester by contact treatment with an alkaline substance.

10. The process defined in claim 9, wherein step (b) is carried out at an elevated temperature.

11. The process defined in claim 9, wherein step (b) includes contact with steam.

12. The process defined in claim 9, wherein step (a) is carried out by contact with a degradation agent selected from the group consisting of amines, zinc salts, oxidizing agents and acids.

13. The process defined in claim 12, wherein the amines are selected from the group consisting of ethylenediamine, ethylenetriamine, and monoethanolamine.

14. The process defined in claim 12, wherein the zinc salts are selected from the group consisting of zinc chloride, zinc sulfate and zinc nitrate.

15. The process defined in claim 12, wherein the oxidizing agents are selected from the group consisting of hydrogen peroxide, sodium hypochlorite and sodium chlorite.

16. The process defined in claim 12, wherein the acids are selected from the group consisting of hydrochloric, sulfuric, nitric, phosphoric and oxalic acids.

* * * * *